US005231734A

United States Patent [19]

Rude

[11] Patent Number: 5,231,734

[45] Date of Patent: Aug. 3, 1993

[54] FRICTION HINGE ASSEMBLY

[75] Inventor: Edward T. Rude, Fairfield, Conn.

[73] Assignee: General Clutch Corporation, Stamford, Conn.

[21] Appl. No.: 787,485

[22] Filed: Nov. 4, 1991

[51] Int. Cl.[5] ..... E05C 17/54; E05D 11/10

[52] U.S. Cl. ..... 16/342; 16/322

[58] Field of Search ..... 16/342, 322, 316, 338

[56] References Cited

U.S. PATENT DOCUMENTS

| | | | |
|---|---|---|---|
| D. 278,309 | 4/1985 | Vickers . | |
| 714,384 | 11/1902 | Luppert | 16/338 |
| 761,517 | 5/1904 | Luppert | 16/338 |
| 4,490,884 | 1/1985 | Vickers . | |
| 4,630,333 | 12/1986 | Vickers . | |
| 5,079,799 | 1/1992 | Rude et al. | 16/342 |

FOREIGN PATENT DOCUMENTS

| | | | |
|---|---|---|---|
| 1458607 | 11/1966 | France | 16/338 |

*Primary Examiner*—John Sipos
*Assistant Examiner*—Carmine Cuda
*Attorney, Agent, or Firm*—Gottlieb, Rackman & Reisman

[57] ABSTRACT

There is disclosed a friction hinge assembly capable of providing hinged motion of two elements with a programmable frictional torque. The frictional torque can be made to vary with the angular orientation of the two hinged elements. The frictional hinge assembly is comprised of a band wrapped around a pintle which is constrained to move rotationally with the first hinged element. One end of the band has a lug configured to press against the second hinged element, exerting thereupon a torque about the pintle. The other end of the band has a tail to which is applied a controlled force to produce the desired frictional torque between the band and the pintle.

19 Claims, 8 Drawing Sheets

FRICTION HINGE ASSEMBLY

BACKGROUND OF THE INVENTION

My invention relates to friction hinges, and, more particularly, to friction hinges for applications demanding an angularly dependent torque.

U.S. Pat. No. 4,630,333 reveals a friction hinge that is adjustable for holding a door or a lid in a particular angular position. The adjustment permits the user to set the hinge, within a certain range, to any desired, constant torque.

U.S. patent application Ser. No. 07/613,025, filed Nov. 14, 1990, reveals a friction hinge capable of providing a different, preset amount of torque for each direction of rotation. This device has, for each direction, a band that provides a presetable, constant slip torque that depends upon the force applied to the tail of the band.

None of the friction hinges revealed in the prior art provides adequately for the problem of a torque requirement that changes with the angle at which the hinge is deployed. Such commonplace items as display cases, briefcases, and portable computer screens have lids which can advantageously be positioned at an angle and held there, the desired angle varying from time to time. The torque needed to maintain the position of such a lid varies as the cosine of the angle between the lid and a horizontal line. If sufficient friction is provided to position the lid just above the horizontal, then it will be needlessly difficult to move the lid when it is nearly vertical.

SUMMARY OF THE INVENTION

My invention provides a unitized friction hinge whose torque varies according to the deployment angle of the hinge according to a predetermined, or preprogrammed function. The torque can be programmed to provide deceleration near the end of the motion of a hinged door or lid, whether the acceleration is due to gravity or to some other force. The inventive hinge comprises a band of slightly flexible material wrapped about a pintle. The pintle is irrotatably affixed to one of the hinged elements. One end of the band has an end configured for rotational contact with the other hinged element. The second end of the band has a tail that contacts a force element which controls the force on the band to provide the desired friction between the band and the pintle. In the simplest embodiment of the invention, the force element is a torsion spring which provides a force on the band that varies linearly with the angular orientation of the band with respect to the pintle. Other force elements can be imagined that produce a wide range of force profiles. It is even possible to use an externally controlled force transducer to provide any arbitrary force algorithm that is desired.

The present invention permits the hinge torque to change as a function of its angular orientation. By employing different arrangements of tail load springs, the torque can remain constant, vary linearly with rotation of the hinged device, or vary stepwise linearly. Stepwise linear variation refers to linear variation within each of several arcs, the slope or spring rate being different in each of the arcs. The torque can also be held constant during one or more arcuate portions of the motion and/or be made variable during others.

For example, the torque might start at 1 in-# and increase at the rate of 0.05 in-# per degree through an angle of 70 degrees. Then the rate of increase might change to 1 in-# per degree through the next 20 degrees of motion. A torque profile of this type might be used, for example, with the screen of a portable computer which requires very little torque to support the lid when it is nearly vertical, and much more when it is almost horizontal. The larger rate of increase near the end of the motion would prevent the lid from slamming and can also provide a pop-up action when the latch is released that holds the lid shut.

The programmed torque is produced by providing a varying force to the tall portion of the band of the device revealed in U.S. patent application Ser. No. 07/613,025. Since that device provides a frictional torque that is proportional to the force exerted by the tail load spring, my invention can provide any frictional torque profile for which a force profile can be devised and applied to the tail of the band. As the hinged parts are rotated with respect to one another, the frictional torque varies according to the variation of the force applied to the tail of the band.

Accordingly, it is an object of the invention to provide a friction hinge assembly in which the frictional torque changes as a function of the angular position of the hinge.

It is a further object of my invention to provide a friction hinge assembly in which the variation in frictional torque is linear with the hinge angle.

It is yet a further object of my invention to provide a friction hinge assembly in which the frictional torque remains constant during a portion of the angular motion of the hinge and varies linearly during another portion of that motion.

It is a still further object of my invention to provide a friction hinge assembly in which the frictional torque is nearly zero during a portion of the angular motion of the hinge, and varies linearly during another portion of that motion.

It is also an object of my invention to provide a friction hinge assembly in which the frictional torque varies linearly throughout its range of angular motion but with different rates of increase in each of several different portions of the motion.

And finally, it is an object of my invention to provide a friction hinge assembly in which the frictional torque varies in a programmed manner.

The inventive friction hinge assembly accordingly comprises the features of construction, combination of elements, and arrangement of parts which will be exemplified in the constructions described hereinafter, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
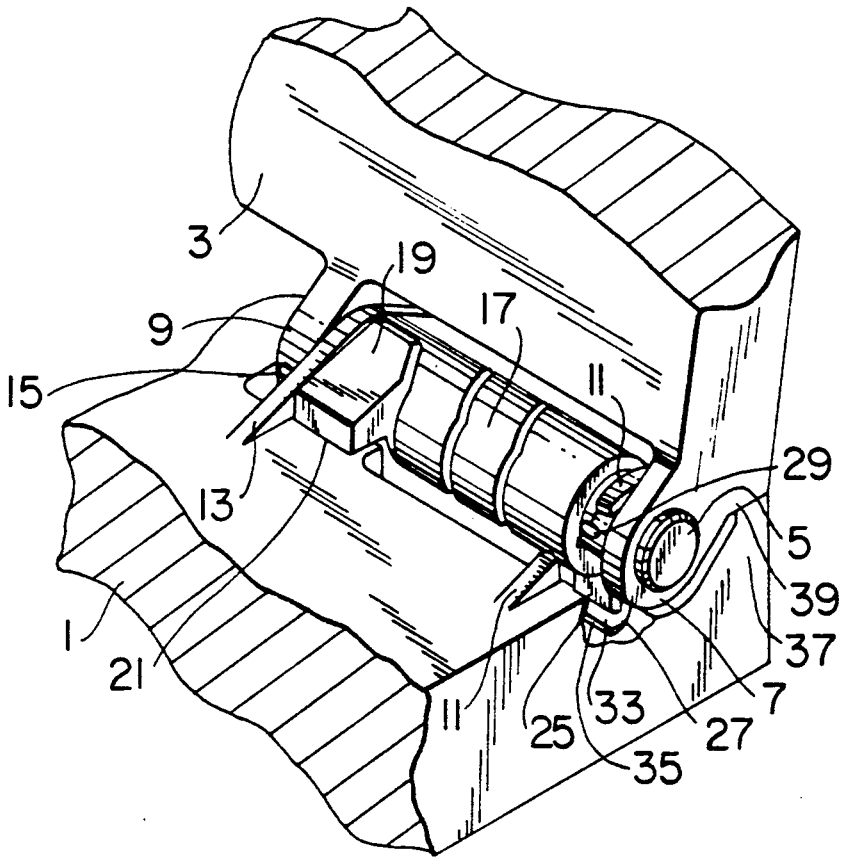
FIG. 1 is an perspective view of my inventive friction hinge assembly in which the two hinged parts are shown only to the extent necessary to reveal the construction and attachment of the hinge.
Figure 2:
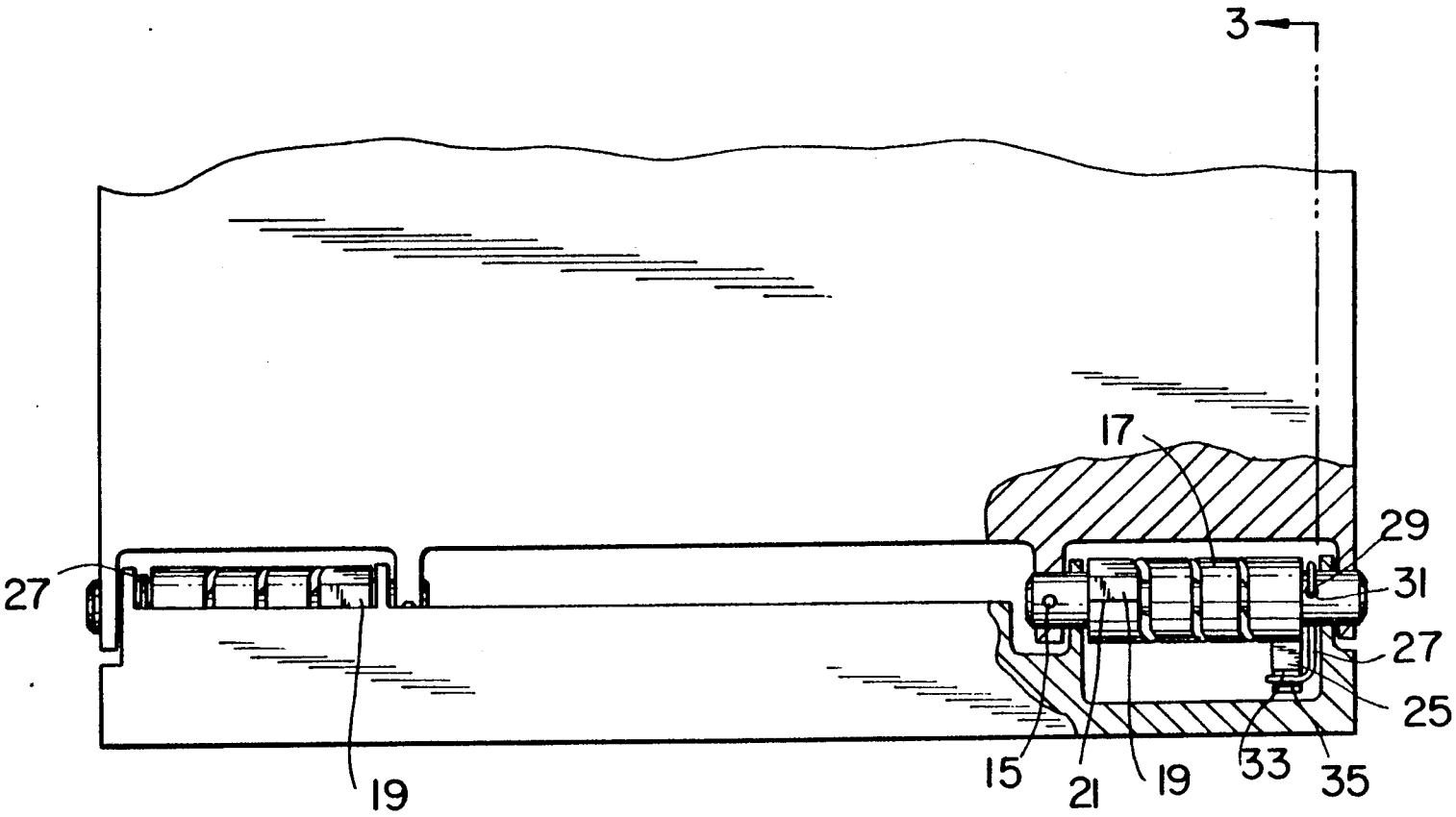
FIG. 2 is a side elevational view, partially shown in cross-section, of the hinge assembly in FIG. 1 in which two friction hinges of my invention are employed. The second hinge is simply a mirror image of the first, providing additional torque as well as a second pivot.

Referring now to FIGS. 1 through 4, the preferred embodiment of the friction hinge assembly of the invention is described. The assembly includes a first hinged element 1 and second hinged element 3, hinged by pintle 5. The two hinged elements, 1 and 3, can be rotated with respect to the other about pintle 5. Flanges 7 and 9 are the mountings for pintle 5. Journals 11 and 13 are attached to, or made a part of, hinged element 1 and are bearings within which pintle 5 can rotate. Journal 11 is partially cut away in FIG. 1 to better reveal other parts of the construction. A rivet or roll pin 15, the end of which is visible in FIGS. 1 and 2, is used to prevent the movement of pintle 5 with respect to flanges 7 and 9. Many other methods for holding pintle 5 in position would be equally effective.

Figure 3:
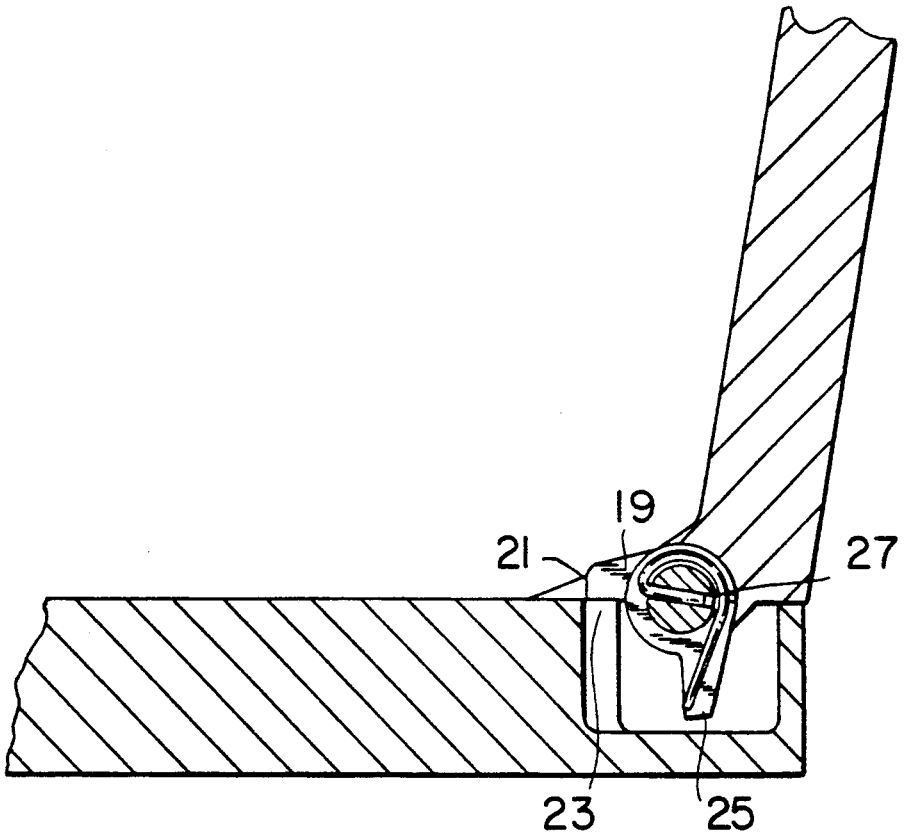
FIG. 3 is a cross-sectional view of the device of FIG. 2, taken along the line 3—3, showing the two hinged parts in the fully open position.
Figure 4:
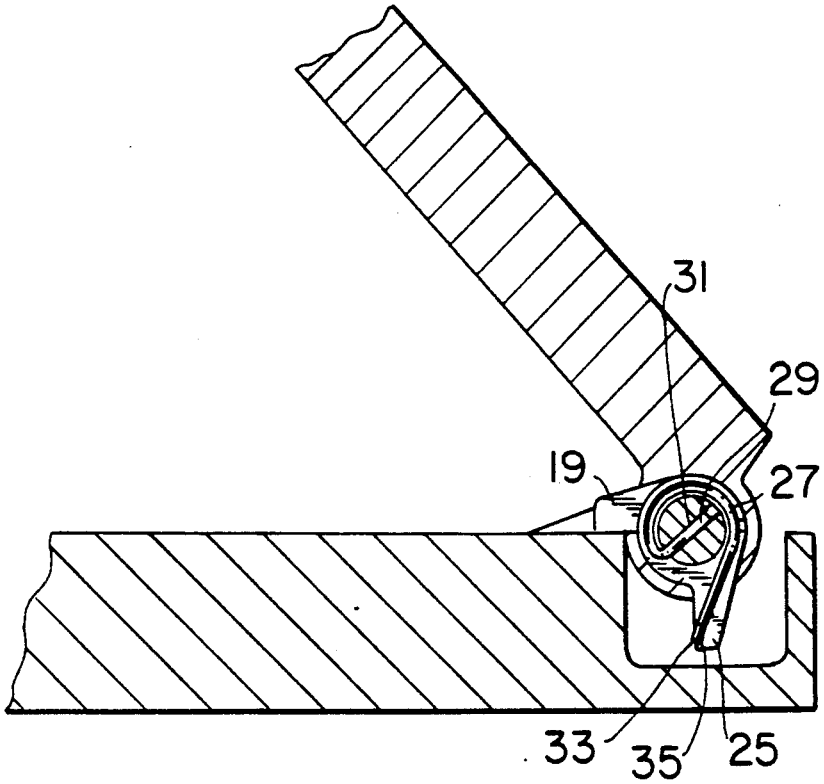
FIG. 4 is the same cross-sectional view as FIG. 3, but with the two hinged parts in a partially closed position.

Band 17 is helically disposed about pintle 5, and has a multiplicity of turns, as many as are appropriate to the application, according to the principles of U.S. patent application Ser. No. 07/613,025. One end of band 17 is formed into, or attached to, lug 19 which has surface 21 for contacting surface 23 on hinged element 1, as is best seen in FIGS. 3 and 4. The other end of band 17 is formed into, or attached to, tail 25.

Torsion spring 27 is disposed about pintle 5. One end 29 of torsion spring 27 is bent radially inward and is captured in hole 31 on pintle 5. The other end 33 of torsion spring 27 is bent parallel to the axis of pintle 5 to fit into groove 35 in tail 25.

Members 37 and 39 act as stops on hinged elements 1 and 3 to limit their rotation with respect to one another. The stops are shown because they are useful in many applications, but they are not an integral or necessary part of my invention.

The frictional torque provided by the inventive friction hinge assembly is achieved in a manner similar to that described in U.S. patent application Ser. No. 07/613,025, except that, in the invention described in the application, the force applied to the tail of the band is constant and does not vary during the motion of the hinge. In the present invention, the force applied to tail 25 of band 17 is made to vary in any desirable manner, producing a correspondingly varying frictional torque. In the preferred embodiment of the present invention, torsion spring 27 is relaxed when hinged element 3 is substantially perpendicular to hinged element 1, as shown in FIG. 3. This results in minimal frictional torque between band 17 and pintle 5 in that orientation. This would be appropriate in an application wherein it is desired to support hinged element 3 against the force of gravity. As hinged element 3 is lowered, as shown in FIG. 4, the force applied by torsion spring 27 to tail 25 increases in proportion to the angular rotation. The frictional torque between band 17 and pintle 5 is given by:

$$T=M\{\exp(uA)\}$$

in which:

T=resulting torque

M=torque applied to tail 25 by torsion spring 27 u=coefficient of friction between band 17 and pintle 5

A=angle of wrap of band 17 around pintle 5.

While the torque due to the gravitational force on hinged element 3 increases sinusoidally rather than linearly, a reasonably good match can be achieved between the gravitational torque and the holding torque.

Figure 5:
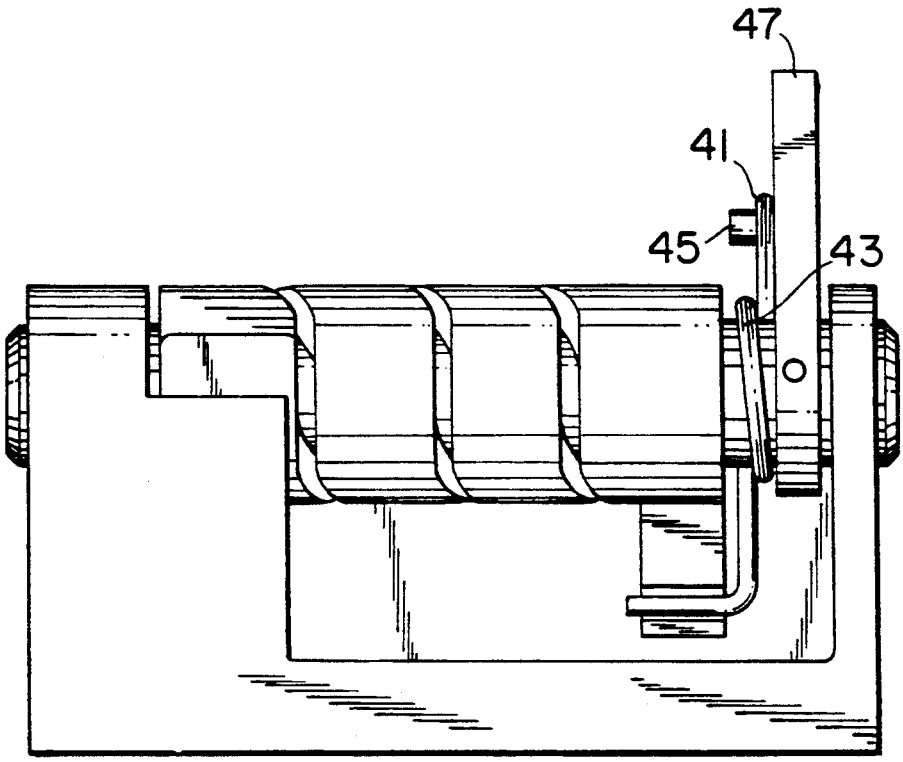
FIG. 5 is a side elevation of another embodiment of my invention in which the torsion spring is anchored in one of the hinged elements.
Figure 6:
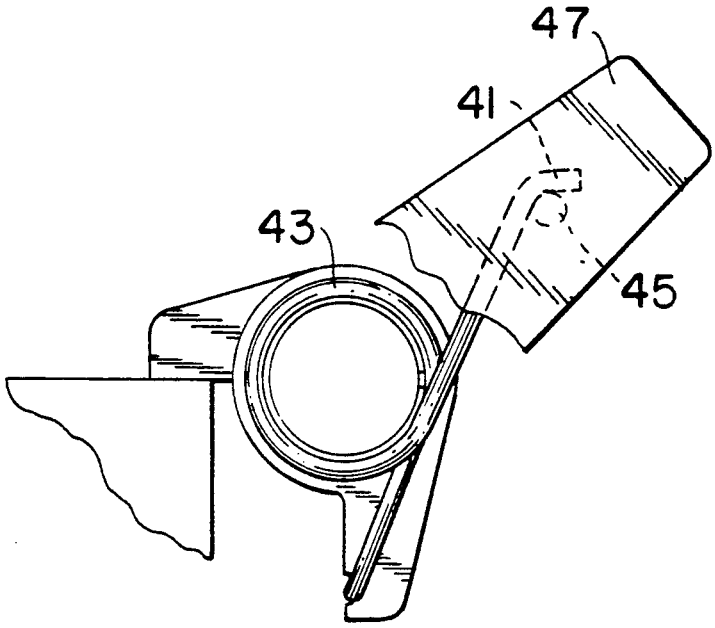
FIG. 6 is a cross-sectional view of the embodiment of FIG. 5.

FIGS. 5 and 6 show an embodiment of my invention similar to the preferred embodiment in all respects, except that in this embodiment, end 41 of torsion spring 43 is hooked about anchor pin 45 on hinged element 47. Either method of terminating the torsion spring is satisfactory, as are others, so long as the end of the spring rotates with respect to band 17.

Figure 7:
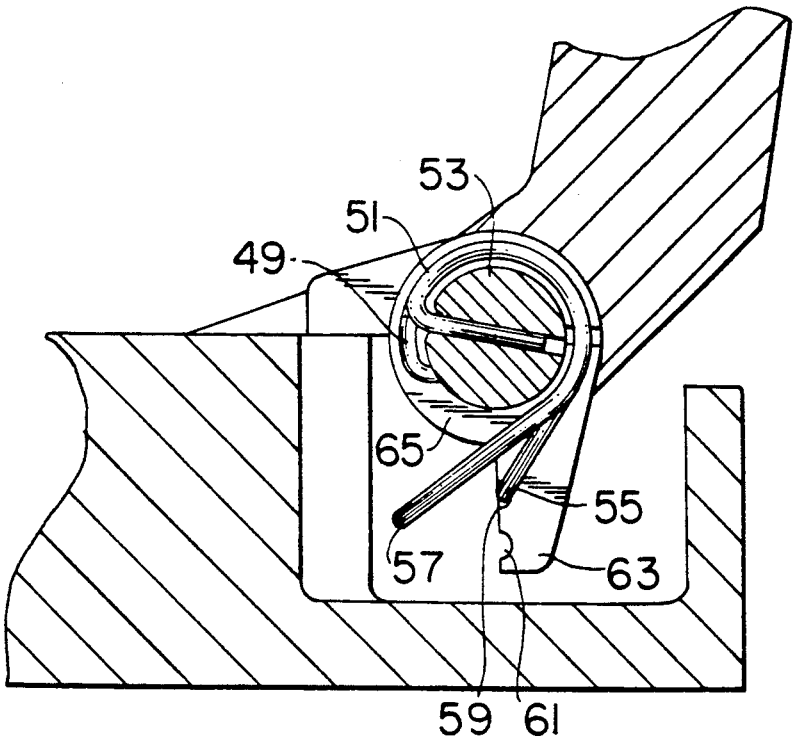
FIG. 7 is an end view, similar to view of FIG. 3, of yet another embodiment of my invention having two torsion springs.

FIG. 7 shows an end view of a friction hinge assembly in which two torsion springs 49 and 51 are provided. Each spring is retained at one end by a radially inward bend inserted into a hole in pintle 53, and each has its other end, 55 and 57 respectively, formed for engagement with grooves 59 and 61 respectively of tail 63 of band 65. During the initial portion of the rotation of pintle 53, torsion spring 51 provides a linearly increasing frictional torque. After a certain angle of rotation, when end 57 of spring 51 contacts tail 63 of band 65, the torque begins to increase at a faster rate due to the simultaneous application of force by both springs to tail 63. Naturally, other spring configurations can be provided that will yield particular torque profiles. If spring 49 is omitted, then there will be almost no frictional torque until tail 63 comes into contact with end 57 of spring 51. This arrangement can be used in situations in which it is desired to have free hinge movement until a certain angle is reached, and a varying torque thereafter.

Figure 8:
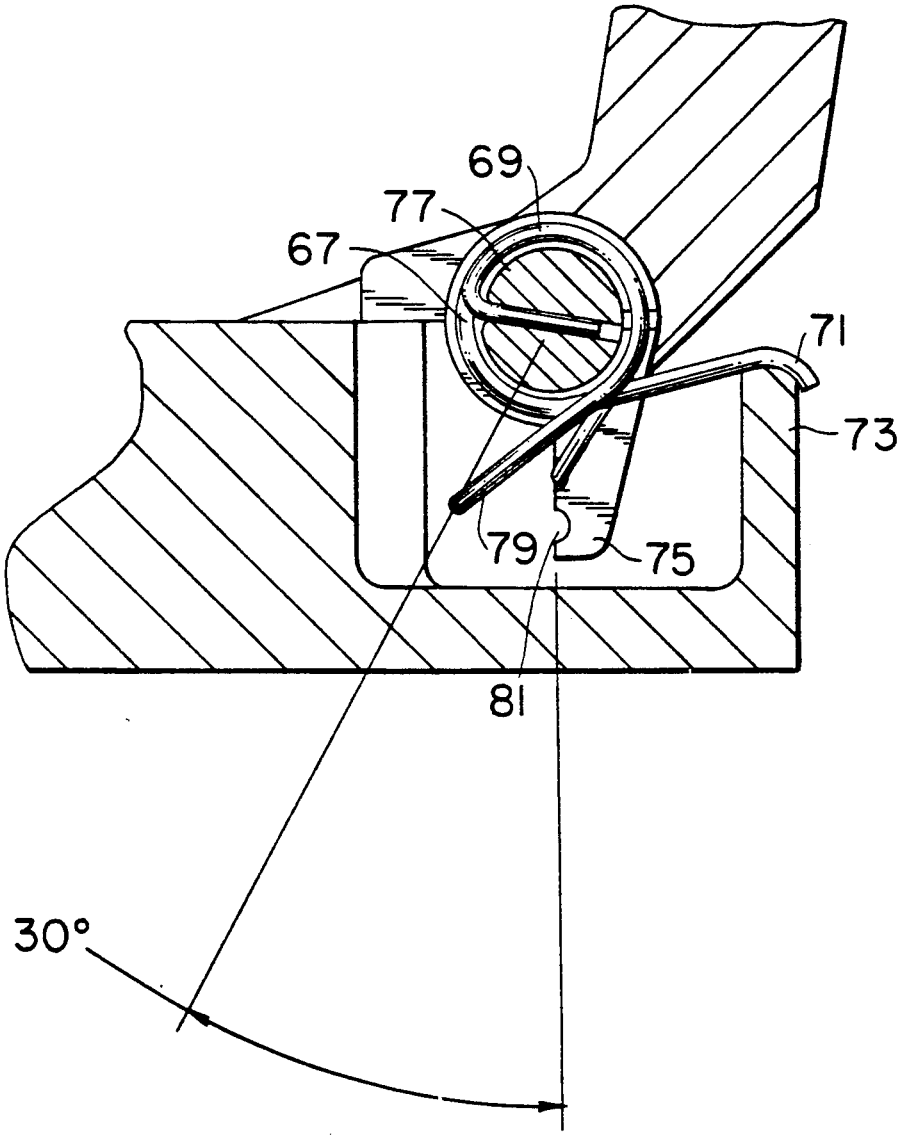
FIG. 8 is an end view, again similar to view of FIG. 3, of still another embodiment of my invention having two torsion springs.

FIG. 8 shows another embodiment of the invention that employs two torsion springs. Torsion spring 67 has one end hooked over hinged element 73 and the other end formed for engagement with tail 75 of the band. Spring 69 has one end received into a hole in pintle 77, and the other end configured to contact groove 81 of band 75. During operation of this hinge assembly, spring 67 does not move, and the force applied by it to tail 75 remains constant, providing a constant level of frictional torque. After rotation of the hinged elements has brought end 79 of torsion spring 69 into contact with tail 75, continued rotation produces a linearly increasing force on tail 75, and thereby, a corresponding linear increase in the frictional torque. This embodiment, therefore, provides constant torque through a portion of the hinge's rotation, and a linearly increasing torque through another portion.

Other means of applying a force to the end of the band can be devised that permit more complex variation of torque as a function of angle. A force transducer can be employed in place of the torsion springs shown that will permit any desired torque profile, even ones that are not uniquely a function of the hinge angle.

It will thus be seen that the objects set forth above among those made apparent from the preceding description, are efficiently attained and, since certain changes may be made in the construction of the inventive friction hinge without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

I claim:

1. A friction hinge assembly comprising:

a first hinged element connected to a rotatable pintle and a second hinged element;

a band helically wound about at least a portion of the pintle having a first end in engagement with said second hinged element and a second end leading into a tail; and means for applying a controlled variable force to said tail that is different at different angular orientations of said hinge elements to enable controlled tightening of the band.

2. The hinge assembly of claim 1, wherein said applying means comprises a spring.

3. The hinge assembly of claim 2, wherein said spring has a first end rotatable with said first hinged element and a second end in selective engagement with said tail.

4. The hinge assembly of claim 3, wherein said tail of said band includes a groove for selectively receiving the second end of said spring.

5. The hinge assembly of claim 4, wherein said second end of said spring is bent parallel to the axis of said pintle for enabling selective reception of said second end in said groove.

6. The hinge assembly of claim 3, wherein said first end of said spring is connected to said pintle for enabling rotation of said first end when said pintle is rotated.

7. The hinge of claim 6, wherein said pintle includes a hole for receiving the first end of said spring.

8. The hinge assembly of claim 3, wherein said first end of said spring is connected to said first hinged element for enabling rotation of said first end when said first hinged element is rotated.

9. The hinge assembly of claim 8, wherein said first hinged element includes a pin to which said first end of said spring is engaged.

10. The hinge assembly of claim 3, wherein the first end of said band includes a lug having a surface for contacting said second hinge element.

11. The hinge assembly of claim 3, further including a second spring for tightening the band about the pintle in a first rotating direction, said second spring having a first end rotatable with said first hinged element and a second end selectively engaged to said tail of said band for enabling a variable force to be applied to said tail.

12. The hinge assembly of claim 11, wherein said tail of said band includes a pair of grooves for selectively receiving the second ends of said first and second springs.

13. The hinge assembly of claim 10, wherein the first ends of said springs are each connected to said pintle for enabling rotation of said ends when said pintle is rotated.

14. The hinge assembly of claim 3, further including a second spring for tightening the band about the pintle in a first rotating direction, said second spring having a first end connected to said second hinged element and a second end selectively engaged to said tail of said band for enabling a substantially constant force to be applied to said tail.

15. A friction hinge assembly comprising:

a first hinged element connected to a rotatable pintle and a second hinged element;

a band helically wound about at least a portion of the pintle having a first end in engagement with said second hinged element and a second end leading into a tail; and a spring for tightening the band about the pintle in a first rotating direction, said spring having a first end rotatable with said first hinged element and a second end in selective engagement with said tail of said band for enabling a variable force to be applied to said tail.

16. The friction hinge assembly of claim 15, wherein said first end of said spring is connected to said pintle for enabling rotation of said first end when said pintle is rotated;

wherein said tail of said band includes a groove for selectively receiving the second end of said spring.

17. The friction hinge assembly of claim 16, wherein said pintle includes a hole for receiving the first end of the spring and wherein the second end of the spring is bent parallel to the axis of the pintle for enabling selective reception of said second end in said groove.

18. The friction hinge assembly of claim 15, wherein said first end of said spring is connected to said first hinged element for enabling rotation of said first end when said first hinge element is rotated;

wherein said tail of said band includes a groove for selectively receiving the second end of said spring.

19. The friction hinge assembly of claim 18, wherein said first hinged element includes a pin to which said first end of said spring is engaged and wherein said second end of the spring is bent parallel to the axis of the pintle for enabling selective reception of said second end in said groove.

* * * * *